109-83 SR
12/18/79 XR 4,178,859

United States Patent [19]
Seiz et al.

[11] 4,178,859
[45] Dec. 18, 1979

[54] DOOR-LIKE CLOSURE

[75] Inventors: Rudolf Seiz, Herrsching; Heinz Eickhoff, Bochum; Herbert Meyer, Bochum; Dieter Steppke, Bochum, all of Fed. Rep. of Germany

[73] Assignee: Bochumer Eisenhütte Heintzmann GmbH & Co., Bochum, Fed. Rep. of Germany

[21] Appl. No.: 829,256

[22] Filed: Aug. 30, 1977

[30] Foreign Application Priority Data

Sep. 3, 1976 [DE] Fed. Rep. of Germany ..... 2639691

[51] Int. Cl.[2] ..... E05G 1/026
[52] U.S. Cl. ..... 109/27; 109/42; 109/76; 109/83; 109/85
[58] Field of Search ..... 109/58, 64, 76, 78, 109/80, 82–85, 24, 26–28, 42; 89/36 R, 36 A, 36 C

[56] References Cited

U.S. PATENT DOCUMENTS

| | | | |
|---|---|---|---|
| 139,414 | 5/1873 | Mulford | 109/83 |
| 317,688 | 5/1885 | Tripp | 109/26 |
| 530,410 | 12/1894 | Giessler | 109/84 X |
| 893,288 | 7/1908 | Walters | 109/84 |
| 960,767 | 6/1910 | Allen | 109/82 |
| 1,026,207 | 5/1912 | Johnson | 109/27 |
| 1,232,330 | 7/1917 | Kenyon | 109/27 |
| 1,440,484 | 1/1923 | Mooney | 109/82 |
| 1,538,223 | 5/1925 | Smyers et al. | 109/82 X |
| 1,805,610 | 5/1931 | Young | 109/24 X |
| 1,888,042 | 11/1932 | Lynn et al. | 109/85 X |
| 2,181,466 | 11/1939 | Shackett | 109/84 X |
| 3,826,172 | 7/1974 | Dawson | 109/82 X |

FOREIGN PATENT DOCUMENTS

| | | | |
|---|---|---|---|
| 2205498 | 8/1973 | Fed. Rep. of Germany | 109/83 |
| 577785 | 5/1946 | United Kingdom | 109/84 |

*Primary Examiner*—David H. Corbin
*Attorney, Agent, or Firm*—Michael J. Striker

[57] ABSTRACT

A door-like closure for passageways in high-risk high-security installations includes a multilayer protective plate which has a rather high resistance to mechanical, thermal and chemical damaging influences, but which can be rather easily damaged by the action of explosives. To reinforce the protective plate, a reinforcing grid is juxtaposed therewith at the major surface thereof which faces the interior of the installation so that, when an attempt is made to destroy the protective plate by explosives, the reinforcing grid not only will increase the resistance of the protective plate to damage but also will permit the explosive shockwave and the possible debris of the protective plate propelled thereby to penetrate through the apertures of the grid without causing any considerable damage to the grid. The apertures of the grid have such dimensions that an intruder will not be able to reach through the aperture into the interior of the installation to, for instance, manipulate the lock of the closure. The grid may consist of a plurality of grid elements of polygonal cross sections which intersect each other at right angles in two sets and in one or two layers, being connected to each other between the two sets. However, the reinforcing grid may be a homogeneous reinforcing plate formed with the apertures. A plurality of passages may be provided in the protective plate, extending substantially parallel to the plane of the protective plate and serving to divert the flow of the effects of the explosion from normal to the plane of the protective plate to substantially parallel thereto. A contact mesh may be incorporated in the protective plate and generate a signal when the latter is damaged or otherwise tampered with.

15 Claims, 9 Drawing Figures

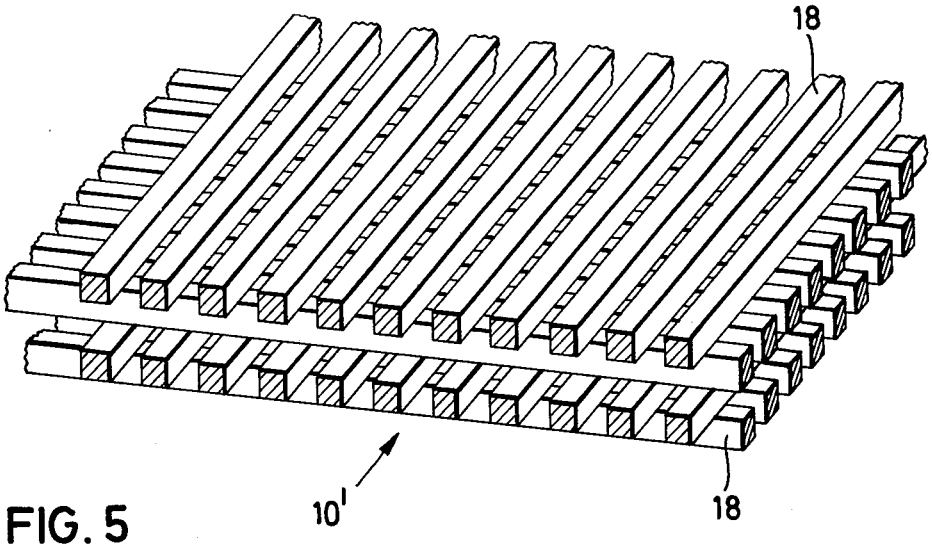
FIG. 5
FIG. 6
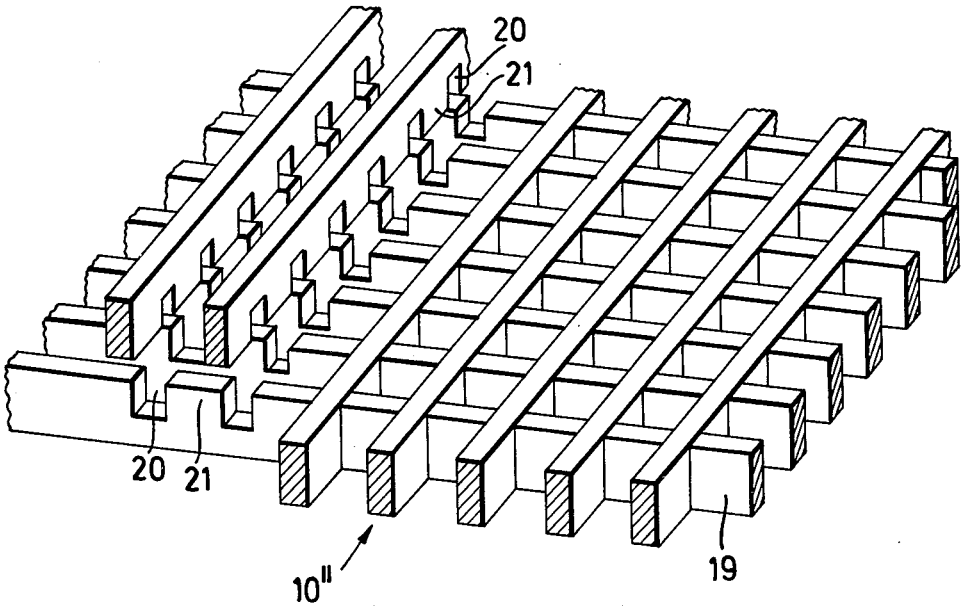

DOOR-LIKE CLOSURE

BACKGROUND OF THE INVENTION

The present invention relates to a door-like closure in general, and more particularly to a safety closure for closing traffic passages of high-risk or high-security installations, such as nuclear power plants, banks, prisons and similar installations.

It is already known to close such passages by door-like closures including a multi-layer protective plate which has a limited endurance for mechanical, thermal, or chemical damaging influences. In many applications, closures of these properties perform the function to satisfaction. However, nuclear power plants, banks, prisons and similar installations are structures which, because of the functions entrusted to them, are exposed to very high security risks. Therefore, it is desired to protect at least some of the passages of these installations by resorting to the use of corresponding closures which are constructed in such a manner that intruders, such as saboteurs, are prevented from entering those structures, which need be highly protected, even when they resort to such measures of mechanical, thermal or chemical nature as to at least partially damage or destroy the above-mentioned closure, at least to the extent necessary for reaching beyond the closure through the destroyed region in order to manipulate certain components or objects located beyond the closure, such as the locking mechanism of the closure.

The requirements which are to be satisfied under these circumstances by the closure of this type are expressed, among others, in a so-called endurance coefficient which is expressed in the terms of the time period for which the closure offers an effective resistance to the destruction thereof when tools, such as drills or cutting torches or the like are used which are still portable.

In this context, there has been already proposed, for use in a door-like closure of the type here under consideration, a multilayer protective plate which has such a composition as to be capable of withstanding any attempts at destruction thereof for an endurance period of an hour at most. This protective plate which is fully suited for withstanding the action of such means for destroying the same which can be usually transported by the intruders to the location of the closure, offers only a small resistance to forces resulting from the explosion of relatively small explosive charges in the order of magnitude corresponding to less than 1 kilogram of TNT (trinitrotoluol). This means that saboteurs in possession of transportable explosive charges in the order of magnitude of merely 3 kilogram TNT can substantially damage such a protective plate with a relative ease and rapidly. With these relatively small explosive charges, especially when the explosive is a plastic explosive, holes can be produced in the closure, when the explosive is applied in a concentrated manner, which have such dimensions as to enable the person using the charge to reach beyond the closure and manipulate the objects or components located behind the closure. This, of course, is very disadvantageous.

SUMMARY OF THE INVENTION

Accordingly, it is a general object of the present invention to avoid the above-discussed disadvantage of the prior-art closures.

More particularly, it is an object of the present invention to so construct a closure for use in high-risk or high-security installations as to substantially reduce the risk of destruction of such a closure by intruders.

A concomitant object of the present invention is to design a closure for the above-mentioned applications which, in addition to a high endurance coefficient for mechanical, thermal and chemical influences, also possesses a high resistivity to the action of the pressure waves and similar effects of an explosion of an explosive charge at the closure.

In pursuance of these objects and others which will become apparent hereafter, one feature of the present invention resides in a door-like closure for passages, particularly for use in high-risk installations which, briefly stated, comprises, in combination, a multilayer protective plate having a given endurance for mechanical, thermal and chemical damaging influences; and a reinforcing grid juxtaposed with and connected to said protective plate. Advantageously, the reinforced grid is arranged at that major surface of the protective plate which faces the interior of the installation, thereby reinforcing the protective plate against forces directed into the interior of the installation. The reinforcing grid may be self-supporting and have a thickness at least equal to that of the protective plate. Advantageously, the reinforcing grid is of a highly elastic and strong material. The reinforcing grid has a plurality of apertures bounded by a plurality of solid portions, the apertures having such dimensions as not to permit an intruder to reach through a respective aperture upon at least a partial removal of the protective plate. The arrangement of a small-dimensioned grid of a material with high elasticity and strength behind the multilayer protective plate results in a situation where, upon ignition of a plastic explosive, even of a high quality, free escape routes are deliberately formed for the penetration of the pressure waves attending the explosion so that the explosion will not damage the reinforcing grid to any appreciable extent despite the fact that the protective plate is supported on the reinforcing grid and thus shearing effects are encountered in the region of contact of the solid portions of the reinforcing grid with the protective plate. In the construction according to the present invention, even the protective plate itself already acts as a pressure-reduction zone so that the effect of the explosion is reduced and the explosion cannot act to its full extent on the reinforcing grid. However, the pressure waves, when they reach the reinforcing grid, do not encounter a homogeneous surface but rather they find free penetration possibilities in the apertures of the grid through which the pressure waves can penetrate and in which they can become decompressed in a controlled manner until they fully lose their effect. This decompression effect results in a situation where, when an explosive charge is used which is of a higher quality than the explosive charge which has been heretofore considered to be critical, such as corresponding to, for instance, approximately 15 kilograms of TNT, a regional destruction of the protective plate cannot be prevented, but where the grid which is arranged behind the protective plate is deformed only to a minimum extent, it at all, and, more importantly, where this deformation of the reinforcing grid does not have any marked influence on the dimensions of the apertures of the reinforcing grid. Therefore, it is not possible, despite the regionally destructed protective plate, to reach through the apertures of the reinforcing grid which still retain their rather small dimensions, in order to manipulate components or objects located behind the closure, such as the locking mechanism of the closure. A further advantage of the closure of the present invention is that the overall thickness of the door-like closure does not exceed that of a prior-art closure, inasmuch as also the endurance constant of the reinforcing grid is to be taken into account when calculating the endurance of the composite closure for mechanical, thermal and chemical damaging influences, in addition to the endurance coefficient of the protective plate proper.

Preferably, the material of the reinforcing grid is steel or alloyed steel having high elasticity and strength. However, it is also possible to utilize another metallic alloy having the required properties. It can be of advantage according to the present invention to utilize a fine-grain structural steel having a rupture strength of between 5,200 and 6,200 kp/cm$^2$ for the reinforcing grid. These proporties are possessed, for instance, by a structural steel of the grade Fe 52 D (ISO 630) which additionally also has the needed weldability.

The multilayer protective plate and the reinforcing grid can be immediately or mediately connected to one another, whether or not the reinforcing grid is self-supporting. It is further advantageous when the respective free major surfaces of the protective plate and of the reinforcing grid are provided with covering plates which substantially conceal the protective plate, on the one hand and the reinforcing grid, on the other hand. As a result of the provision of the covering plates, the recognition of the construction of the closure is at least rendered more difficult than in the absence of such covering plates, if not altogether prevented. In addition thereto, the appearance of the closure can be influenced rather arbitrarily within a wide range.

In a currently preferred embodiment of the present invention, the door-like closure comprises a circumferentially complete frame, and the protective plate and the reinforcing grid are jointly supported in the frame. Advantageously, the frame includes interconnected angle beams. Then, the two covering plates are so mounted on the frame as to be juxtaposed with and substantially conceal the protective plate and the reinforcing grid, respectively. The covering plate may be, for instance, of a metal sheet material which itself has a high endurance coefficient. The angle beams can be so configurated and arranged that a destruction of the closure even from the minor surfaces of the door-like closure is possible only with a considerable expenditure of corresponding tools and within a prolonged time period. As a rule, such tools are not available to or not carried by the intruders who usually also do not have sufficient time period available for accomplishing the task of damaging or destroying the minor surfaces of the closure. Even the angle beams can be augmented in their resistance or endurance for mechanical, thermal or chemical influences, for instance, by arranging a multilayer additional protective plate behind the same.

According to a currently preferred aspect of the present invention, the distance between any two neighboring, substantially parallel, solid portions of the grid amounts to 2.5 to 4 times the width of the respective solid portions which bound the aperture, as measured in the plane of the reinforcing grid. This proportion assures, within the framework of a still reasonable accumulation of material, the provision of free spaces between the solid portions which permit a reliable depressurization of the shockwaves resulting from the explosion, but which free spaces still do not permit an intruder to reach therethrough beyond the partially destroyed closure.

In this connection, it is especially advantageous, according to a further facet of the present invention when the distance between the solid portions of the reinforcing grid approximately equals 3 to 3.5 times the width of the solid portion. It is especially advantageous when the distance between the solid portions of the reinforcing grid amounts to approximately 7 centimeters.

An advantageous embodiment of the reinforcing grid is achieved, according to the present invention, when the reinforcing grid includes a plurality of interconnected solid portions which intersect one another at substantially right angles. Advantageously, the solid portions are discrete grid elements arranged in two sets, each of which extends substantially normal to the other set in the plane of the reinforcing grid. It is further advantageous when the grid elements at least of one of the sets have recesses which receive the grid elements of the other set therein. However, it is even more advantageous when also the grid elements of the other set have additional ones of the recesses which engage the grid elements of the one set at the recesses thereof. The grid elements, upon assembly of the two sets in the above-discussed manner, are connected to one another, for instance, by welding. In this manner, there is obtained a reinforcing grid of a uniform thickness the basic components of which are reliably attached to one another, the reinforcing grid possessing the required strength accompanied by a high elasticity, which is especially advantageous when the closure is subject to dynamic shock loads, such as those attendant to the explosion of an explosive charge.

A further embodiment of the present invention has the reinforcing grid constructed as a homogeneous reinforcing plate which has a plurality of spaced apertures provided therein. The apertures can be provided in the reinforcing plate by means of stamping, pressing, or various cutting procedures, such as torch or electric arc cutting. The shape of the apertures can be square, rectangular, round, hexagonal or oval. However, even rhombic shapes are imaginable and within the scope of the present invention. The solid portions of the reinforcing grid then extend in correspondence to the respective shapes of the apertures. Additionally, it is also possible to manufacture the reinforcing grid by resorting to molding operations, in which event the shapes of the apertures and the distribution thereof may be arbitrary and even irregular.

A further advantageous embodiment of the present invention employs a plurality of reinforcing elements of polygonal cross sections which are arranged in at least two layers adjacent one another and which are interconnected with each other between the layers. These polygonal reinforcing elements can be, for instance, elongated bars of square cross sections. Instead of two layers, there can also be provided three or four or even more of such layers of polygonal reinforcing elements which are interconnected with one another between the layers. The polygonal reinforcing elements can bound quadratic or rectangular apertures therebetween. However, here again, the reinforcing element can bound rhombically shaped apertures.

With respect to the protective plate which is arranged in front of the reinforcing grid, an advantageous embodiment thereof resides, according to the invention, in the provision therein of at least one layer of substantially parallel perforated metal sheets which are embedded in a vulcanized compound of a rubber mixture and ceramic particles. The perforated metal sheets are arranged substantially parallel to the major surface of the protective plate. Such a zone, in addition to having a de-pressurizing effect on the waves generated during the explosion of an explosive charge, has the advantage that it offers a substantial resistance to the action of cutting torches or the like. Furthermore, any drilling through this protective plate is rendered difficult due to the presence, within the compound, of the ceramic particles which are irregularly distributed, and of the perforated metal sheets which are arranged in the compound at a distance from one another. As a result of this composition, the drilling tool deviates from its track, breaks and is thus rendered inoperative within a relatively short period of time. Even the material of the perforated metal sheets preferably has a high resistance to the action of cutting torches.

It is further proposed by the present invention that the protective plate include a layer of foamed asbestos which is accommodated in a casing of steel sheets that has a high resistance to thermal influences. Advantageously, such a layer has a composition of irregularly layered steel wool and light metal particles embedded therein. The light metal particles may be aluminum particles or aluminum alloy particles; the composition may be augmented by ceramic particles. Such a layer can, by itself, constitute a pressure-reduction zone in front of the small-aperture reinforcing grid. However, this layer can also be used in combination with the above-discussed layer which is obtained by vulcanization. These two layers are then arranged immediately adjacent one another. The irregularly layered steel wool is also a material which has a high resistance to thermal influences generated, for instance, by cutting torches. Alloyed steel can be used therein. The ceramic particles as well as the irregularly layered steel wood render the destruction of or damage to the protective plate by drilling quite difficult even in this embodiment of the present invention.

In order to enhance the depressurization of the shock wave resulting from an explosion with an attendant reduction of the effect of the explosion of the explosive charge, it is further proposed by the present invention to equip the protective plate with channel-shaped hollow spaces which extend substantially parallel to the plane of the protective plate. These hollow spaces can extend either horizontally or vertically, or even in any other direction. They can be provided either in the layer of foamed asbestos, or in the layer obtained by vulcanization. The purpose of these channel-shaped hollow spaces is to provide an intended path for the shock waves of the explosion to achieve depressurization thereof, in order to thus reduce the extent of the damage to the material of the closure and to keep the extent of the damage thereto and the size of the opening broken thereinto at such a low level as possible.

An additional protection against the thermal influences can be obtained when, as proposed by the present invention, the protective plate includes a layer of mineral wool, such as glass wool. It is further advantageous, as proposed by the present invention, to incorporate into the protective plate a contact mesh which generates electrical signal upon the occurrence of damage to the protective plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 5 is a partial perspective view of a reinforcing grid which can be used in the closure of FIG. 1; and FIG. 6 is a partial perspective view of another reinforcing grid which can be used in the closure of FIG. 1.

DETAILED DISCUSSION OF THE PREFERRED EMBODIMENT

Figure 1:
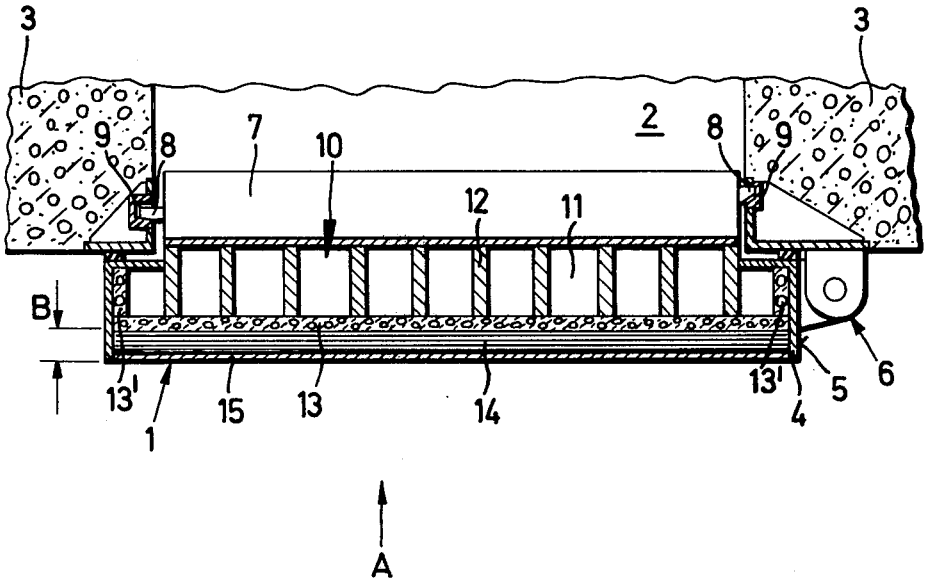
FIG. 1 is a somewhat diagrammatic sectional view of a door-like closure of the present invention.

Referring now to the drawing in detail, and first to FIG. 1 thereof, it may be seen that the reference numeral 1 designates a door-like closure which is to be used, for instance, in a personnel passage 2 of a nuclear power plant. The closure is illustrated as being in its closed position. The reference numeral 3 indicates the limiting walls which bound the passage 2, the walls 3 being made of, for instance, reinforced concrete.

The closure 1 includes a circumferentially complete frame 4 of angle beams which, when viewed in the direction of the arrow A of FIG. 1, has a rectangular contour. The frame 4 has a vertical portion 5 which is pivotable on the wall 3 by means of hinges 6 from the illustrated closed position into the open position of the frame 4 and thus of the closure 1.

A lining 7 is mounted in the frame 4, and a latching or locking mechanism of a conventional construction is accommodated within the lining 7, the actuating portions of the mechanism being located at the inner and at the outer side of the closure 1. The latching or locking mechanism together with the actuating portions thereof has been omitted from the drawing in order not to unduly encumber the same. However, the drawing illustrates those parts of the locking mechanism which project from the closure 1 into the passage 2 in the locking position thereof, including the locking elements 8 and the receiving elements 9 which cooperate with one another in such a manner that the closed closure 1 cannot be removed from the passage 2 even when the door hinges 6 are separated from the frame 4. The locking elements 8 are also received within the lining 7 of the door-like closure 1, and are displaced between their locking and unlocking positions from within the lining 7.

A reinforcing grid 10 having relatively small-sized apertures is incorporated into and connected to the frame 4.

The reinforcing grid 10 may, for instance, be constituted by an originally homogeneous plate which is afterwards provided with square apertures 11 by resorting to conventional cutting procedures, such as electric arc cutting or torch cutting. The apertures 11 are bounded, on all sides, by solid portions 12. The lining 7 is attached to the reinforcing grid 10 at the side thereof which faces the passage 2. The reinforcing grid 10 consists of a material having a high elasticity and strength, for instance, of a weldable fine-grain structural steel of the grade Fe 52 D (ISO 630) which has a rupture strength of 5,200 to 6,200 kp/cm$^2$.

The dimensions of the apertures 11 are such that a normal human hand cannot be passed therethrough. For instance, the distance between the solid portions 12 amounts to 7 centimeters, and the ratio of between 3:1 and 3.5:1 of the distance with respect to the width of the solid portions 12 constitutes a particularly advantageous value.

At the side of the reinforcing grid 10 which faces away from the passage 2, there is provided, also within the frame 4, a multilayer protective plate B which is equipped with a protective layer 13 having a limited endurance coefficient for mechanical, thermal and chemical damaging influences. This layer 13 can consist, for instance, of substantially parallel perforated metal sheets embedded in a vulcanized compound of a rubber mixture and ceramic particles. This layer is not illustrated in greater detail as to its composition. On the protective layer 13, there is provided a further layer 14 within the frame 4 which consists, for instance, of glass wool and has a high resistance to thermal influences attendant to, for instance, the application of a torch to the closure 1. The protective layer 13 as well as the further layer 14 form, in the event of subjection thereof to shock waves attendant to an explosion of an explosive charge at the closure 1, pressure-reduction zones by which the explosive effect of the explosive charge oriented toward the reinforcing grid 10 is diminished. At the exterior of the layer 4, there is then mounted a covering metal sheet 15 which extends over substantially the entire area of the layer 14 and which is connected to the frame 4. Even the frame 4 can be augmented by a protective layer 13' arranged behind the same, which has a composition corresponding to that of the protective layer 13.

Figure 2A:
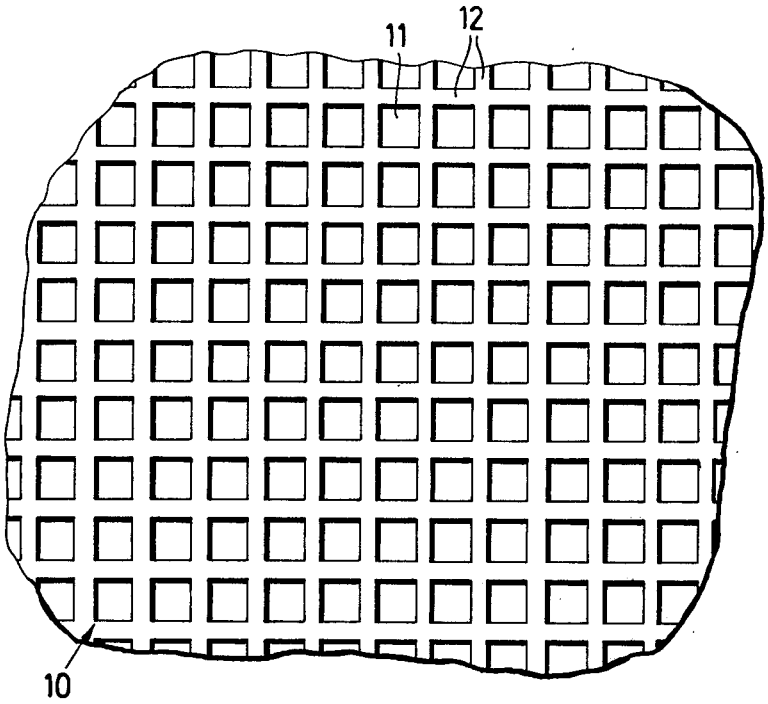
FIG. 2*a* is a partial elevational view of the reinforcing grid employed in the closure of FIG. 2.
Figure 2:
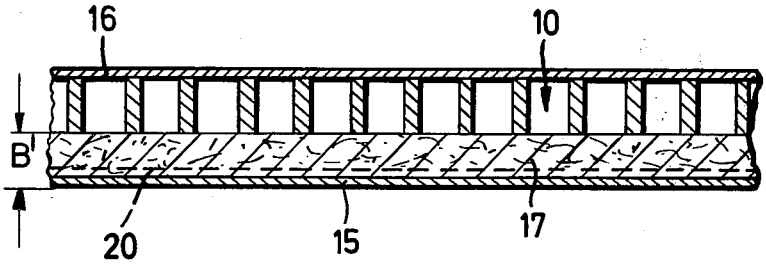
FIG. 2 is a partial section of a modification of the door-like closure of FIG. 1.

The modification of the door-like closure which is illustrated in FIG. 2 has a reinforcing grid 10 which is juxtaposed with a protective plate B' equipped with a pressure-reduction zone consisting of a protective layer 17, which also has a limited endurance coefficient for mechanical, thermal and chemical damaging influences. This protective layer 17 consists, for instance, of foamed asbestos which is confined within metallic sheet casings having a high resistance to thermal influences. Advantageously, the protective layer 17 has a composition of irregularly layered steel wool and light metal particles, such as aluminum or aluminum alloy particles, embedded therein, the composition being advantageously augmented by ceramic particles. Even this layer 17 is not illustrated in detail as to its composition. At the exposed side of the reinforcing grid 10 and of the protective layer 17, there are attached substantially complete covering metal sheet members 15 and 16, respectively. Even this modification of the closure 1 can be accommodated in the frame 4 to be circumferentially surrounded thereby in the manner illustrated in FIG. 1. However, the reinforcing grid 10 can also be so constructed as to be self-supporting. For instance, the reinforcing grid 10 can have the shape illustrated in FIG. 1.

Figure 3A:
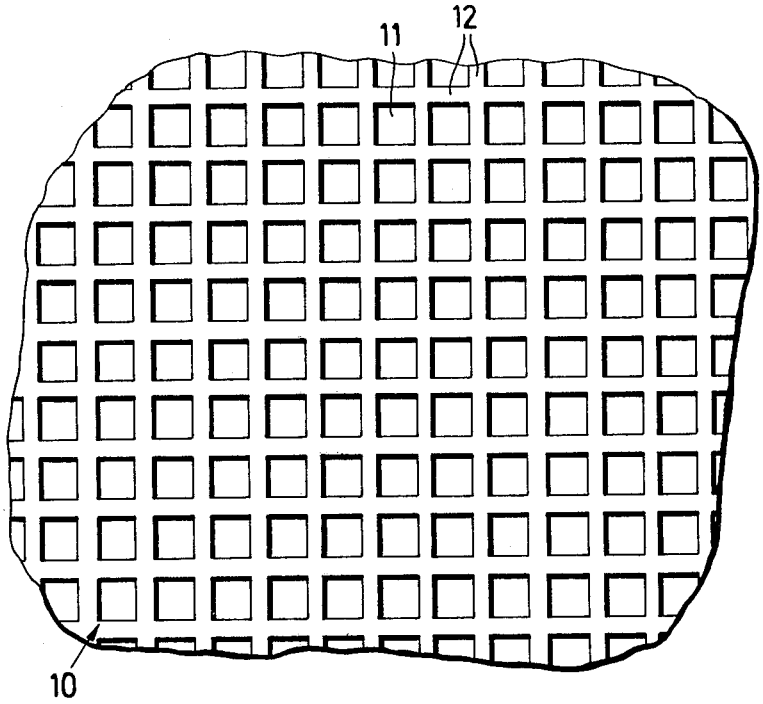
FIG. 3*a* is a view similar to FIG. 2*a* but of the modification of FIG. 3.
Figure 3:
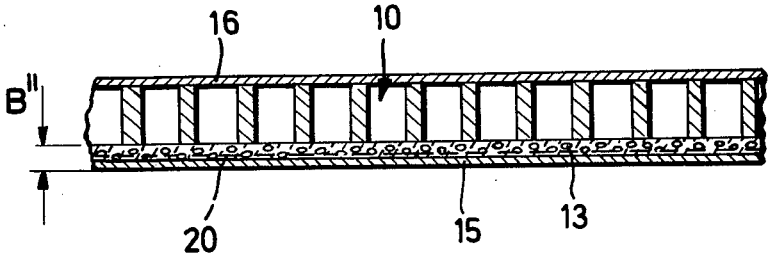
FIG. 3 is a view similar to FIG. 2 but of a further modification.

In the modification illustrated in FIG. 3, the pressure-reduction zone in front of the reinforcing grid 10 consists of a protective plate B'' including a protective layer 13 which includes substantially parallel perforated metal sheets embedded in a vulcanized compound of a rubber mixture and ceramic particles. At the exposed surfaces of the reinforcing grid 10 and of the protective layer 13, there are also mounted substantially complete covering metal sheet members 15 and 16. The reinforcing grid 10 can have a shape corresponding to that illustrated in FIGS. 1 or 2.

Figure 4A:
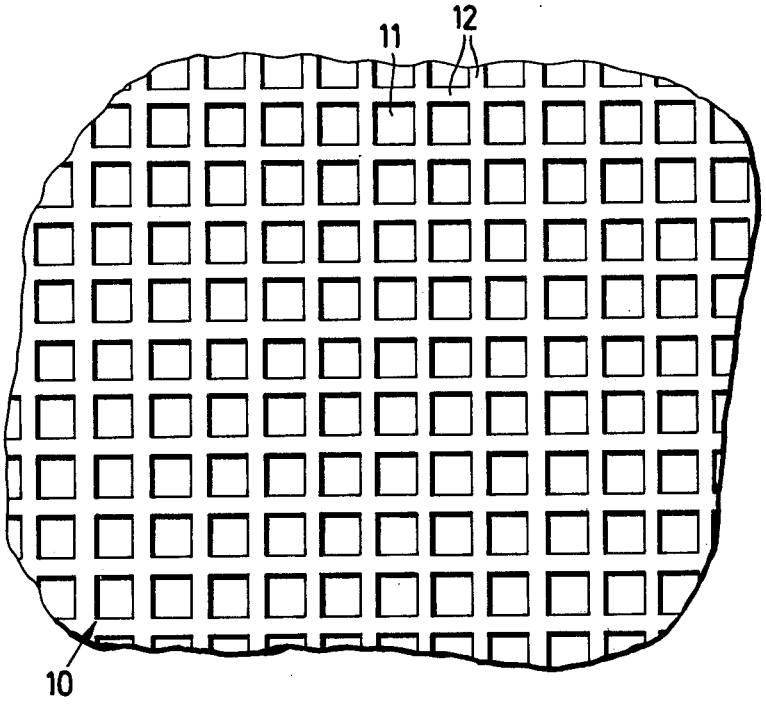
FIG. 4*a* is a view similar to FIG. 2*a* but of the modification of FIG. 4.
Figure 4:
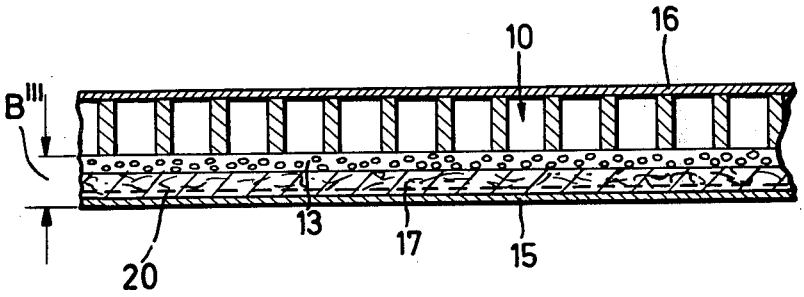
FIG. 4 is a yet another modification similar to FIG. 2.

FIG. 4 illustrates a modification of the door-like closure of FIG. 1 in which a protective plate B''' consists of the protective layer 13 including substantially parallel perforated metal sheets embedded in a vulcanized compound of a rubber mixture and ceramic particles, and a layer 17 which consists of foamed asbestos accommodated in a casing of steel sheets which has a high resistance to thermal influences. The layer 17 advantageously has a composition of irregularly layered steel wool and light metal particles, such as aluminum and aluminum alloy particles, embedded therein. Advantageously, the composition is augmented by ceramic particles. At the exposed surface of the reinforcing grid 10 and of the protective layer 17, there are again attached substantially complete covering metal sheet members 15 and 17. The reinforcing grid can correspond to the reinforcing grids 10 of FIGS. 1 to 3. The reinforcing grid 10 may be embedded in the frame 4 together with the layers 13 and 17. However, the reinforcing grid 10 can also take over the supporting function of the layers 13 and 17.

What is further contemplated by the present invention is a combination of the protective layer 14 with the protective layer 17, or a triple combination of the protective layers 13, 14 and 17.

In FIG. 5, there is indicated a construction of a reinforcing grid 10' which consists of four layers of crosswise arranged elongated rods 18 of square cross-sections which are juxtaposed with one another in separate layers in different sets of arrays and which are welded to one another between the layers. This reinforcing grid 10' can be utilized instead of the reinforcing grid 10 of FIGS. 1 to 4.

A partial section of a reinforcing grid 10'' is illustrated in FIG. 6, the reinforcing grid 10'' consisting of elongated bars 19 arranged in two arrays which cross one another. It can be ascertained from FIG. 6 that the bars 19 have recesses 20 arranged between adjacent teeth 21, the bars 19 of the two arrays being so arranged that the respective recesses 20 of one of the arrays are received between the teeth 21 of the other array. After the assembly of the bars 19 of the two arrays, they are interconnected with one another, for instance, by welding so that the obtained reinforcing grid 10'' has a high elasticity and strength. Even this embodiment of the reinforcing grid 10' can be used in the closure 1 of FIG. 1 instead of the reinforcing grid 10 thereof or of FIGS. 2 to 4, or of the reinforcing grid 10' of FIG. 5.

The protective layers 13, 14 or 17 of all of the modifications can be provided with non-illustrated channel-shaped hollow spaces which extend substantially parallel to the plane of the respective protective layer 13, 14 or 17, which provide, during the action of an explosive charge on the closure 1, for additional pressure reduction transversely to the reinforcing grid 10, 10' or 10''.

It is further proposed by the present invention to additionally incorporate a contact mesh 22 in the respective protective plate B, B', B'' or B''', which contact mesh triggers electrical signals upon damage thereto, such electric signals being transmitted to a supervising location.

It will be understood that each of the elements described above, or two or more together, may also find a useful application in other types of constructions differing from the types described above.

While the invention has been illustrated and described as embodied in a door-like closure for passages of high-risk installations, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An improved high-security door structure of the type only slowly destructible by non-explosive mechanical, thermal and chemical attack and comprising a door frame and means mounting the door frame for movement between closed and open positions, a multi-layer metallic protective front plate of uninterrupted surface area mounted on the door frame and being of the type only slowly destructible by non-explosive mechanical, thermal and chemical attack but destructible by discharge of locally applied explosive material and a metallic door plate of uninterrupted surface area mounted on the back side of the door frame, the improvement comprising:

a metal back-up grid constituted by regularly organized and interconnected solid portions defining intermediate themselves an array of regularly disposed empty apertures interiorly of the front plate and door plate portions has a width measured in the plane of said grid, the distance between any two neighboring solid portions amounts to 2.5 to 4 times said width, said apertures having such dimensions as not to permit an intruder to reach through a respective aperture the back-up grid being juxtaposed with and connected to the back side of the multi-layer protective front plate, the thickness of the back-up grid as measured in the direction perpendicular to the general plane of the door being at least substantially equal to the thickness of the multi-layer protective front plate, the apertures of the array of regularly disposed apertures being empty and due to the thickness of the grid having a depth measured in the direction perpendicular to the general plane of the door which is at least substantially equal to the thickness of the multi-layer protective front plate and serving upon the discharge of explosive material locally applied to a section of the front face of the protective front plate for taking up the explosive pressure shock generated at such section so as to permit explosive destruction of such section and dissipation of the local explosive pressure shock into the respective adjoining aperture so as to localize the damage to the protective front plate without substantial damage to the reminder of the back-up grid.

2. A door as defined in claim 1, wherein said grid is self-supporting.

3. A door as defined in claim 1, wherein said grid is made of a fine-grain structural steel having a rupture strength of between 5,200 and 6,200 kp/cm$^2$.

4. A door as defined in claim 1, the frame being a circumferentially complete frame.

5. A door as defined in claim 4, wherein said frame includes interconnected angle beams.

6. A door as defined in claim 1, wherein said distance amounts to between 3 and 3.5 times said width.

7. A door as defined in claim 1, wherein said distance amounts to approximately 7 centimeters.

8. A door as defined in claim 1, wherein said reinforcing grid includes a plurality of interconnected solid portions which intersect one another at substantially right angles.

9. A door as defined in claim 8, wherein said solid portions are discrete grid elements arranged in two sets each of which extends substantially normal to the other set in the plane of said grid.

10. A door as defined in claim 9, wherein said grid elements of at least one of said sets have recesses which receive said grid elements of the other set.

11. A door as defined in claim 10, wherein said grid elements of said other set also have additional ones of said recesses which engage said grid elements of said one set at said recesses thereof.

12. A combination as defined in claim 1, wherein said reinforcing grid is a homogeneous plate having said plurality of apertures spacedly provided therein.

13. A combination as defined in claim 1, wherein said grid includes a plurality of grid elements of polygonal cross sections which are arranged in at least two layers adjacent one another and are interconnected with each other between said layers.

14. A door as defined in claim 1, wherein said protective plate includes at least one layer of mineral wool.

15. A door as defined in claim 14, wherein said mineral wool is glass wool.

* * * * *